US006467303B2

(12) United States Patent
Ross

(10) Patent No.: US 6,467,303 B2
(45) Date of Patent: Oct. 22, 2002

(54) HOT DISCHARGE GAS DESUPERHEATER

(76) Inventor: James Ross, 15600 Egan Rd., Jamestown, CA (US) 95327

( * ) Notice: Subject to any disclaimer, the term of this patent is extended or adjusted under 35 U.S.C. 154(b) by 0 days.

(21) Appl. No.: 09/750,236

(22) Filed: Dec. 26, 2000

(65) Prior Publication Data

US 2001/0027664 A1 Oct. 11, 2001

Related U.S. Application Data

(60) Provisional application No. 60/172,005, filed on Dec. 23, 1999.

(51) Int. Cl.[7] ..... F25B 39/04; F25B 41/00
(52) U.S. Cl. ..... 62/509; 62/513
(58) Field of Search ..... 62/513, 509, 84

(56) References Cited

U.S. PATENT DOCUMENTS

| | | | | |
|---|---|---|---|---|
| 1,946,328 A | | 2/1934 | Neff | |
| 3,343,375 A | | 9/1967 | Quick | |
| 4,311,498 A | | 1/1982 | Miller | |
| 4,419,865 A | | 12/1983 | Szymaszek | |
| 4,454,720 A | | 6/1984 | Leibowitz | |
| 4,506,523 A | | 3/1985 | DiCarlo et al. | |
| 4,554,799 A | * | 11/1985 | Pallanch | 62/509 |
| 4,621,505 A | | 11/1986 | Ares et al. | |
| 5,016,447 A | * | 5/1991 | Lane et al. | 62/470 |
| 5,041,246 A | | 8/1991 | Garrison | |
| 5,097,677 A | | 3/1992 | Holtzapple | |
| 5,150,580 A | | 9/1992 | Hyde | |
| 5,198,969 A | | 3/1993 | Redl et al. | |
| 5,240,651 A | * | 8/1993 | Rawal | 2661/78.2 |
| 5,291,744 A | | 3/1994 | Hyde | |
| 5,336,451 A | | 8/1994 | Lovick | |
| 5,509,462 A | | 4/1996 | Demko et al. | |
| 5,727,453 A | * | 3/1998 | Tippmann | 99/483 |
| 5,921,092 A | | 7/1999 | Behr et al. | |
| 5,924,297 A | | 7/1999 | Wolff et al. | |

OTHER PUBLICATIONS

Pauling, L. (1970) *General Chemistry*, Dover Publications, N.Y., p. 504, New York, New York.
Sandofsky, M(8/97) *Store Equipment and Design*, p. 37, New York, New York.
Dossat, R.J. (1997) *Principles of Refrigeration*, 4th ed., Prentice–Hall International, Inc., pp. 108, 120–123, 322–323, Engelwood Cliffs, New Jersey.
Stoecker, W.F. (1998) *Industrial Refrigeration Handbook*, McGraw–Hill, New York, New York pp. 72–74.
Dossat, R.J. (1997) *Principles of Refrigeration*, 4th ed., Prentice–Hall International, Inc., Engelwood Cliffs, New Jersey, pp. 294–296, 317–323.
Stoecker, W.F. (1998) *Industrial Refrigeration Handbook*, McGraw–Hill, New York, New York, pp. 367–390.

* cited by examiner

*Primary Examiner*—William C. Doerrler
(74) *Attorney, Agent, or Firm*—Coudert Brothers LLP

(57) ABSTRACT

A passive desuperheater for a vapor compression refrigeration system is disclosed. The passive desuperheater includes a chamber having two inlets and an outlet, the first inlet for introducing superheated gas into the chamber, the second inlet for introducing cool liquid refrigerant into the chamber and the outlet for outputting the desuperheated gas. The flow of cool liquid refrigerant into the chamber is generated by a gravity drop, resulting in the mixing of the liquid refrigerant with the superheated gas, such that desuperheated gas is output at the outlet. In an alternative embodiment, the hot discharge gas is input through the bottom of a shell and tube condenser and then exposed to the cool liquid refrigerant in the condenser. The desuperheater according to the present invention also can be used to remove oil from the hot discharge gas during desuperheating. Desuperheating can also be obtained by passing the superheated gas through a pipe immersed in the cool liquid refrigerant.

24 Claims, 10 Drawing Sheets

HOT DISCHARGE GAS DESUPERHEATER

This application claims the benefit of provisional application 60/172,005 filed Dec. 23, 1999.

FIELD OF THE INVENTION

The present invention relates to vapor compression refrigeration systems and, more specifically, to the use of passive desuperheating of the gaseous refrigerant used in the refrigeration system.

BACKGROUND OF THE INVENTION

The field of vapor compression refrigeration systems includes refrigeration systems and air conditioners. Prior art closed vapor compression refrigeration systems utilize a cycle wherein the liquid refrigerant vaporizes to produce useful cooling, and where the following steps are used: (1) expansion of the liquid refrigerant (pressure reduction); (2) vaporization of the expanded liquid refrigerant in an evaporator to produce useful cooling (the refrigerant absorbs heat in this step); (3) compression of the gaseous refrigerant to form a compressed gaseous refrigerant (the refrigerant absorbs further heat in this step); and (4) condensation of the gas to condense the gaseous refrigerant back into a cool liquid refrigerant. The above steps are driven by the energy used to drive the compressor. Some prior art devices also include a reservoir, for the purpose of storing the cooled liquid refrigerant. Some prior art devices also require the use of oil to lubricate the compressor and therefore also require the use of oil separators to remove oil from the refrigerant, thus reducing contamination of the refrigeration system.

The refrigerant can absorb heat at various points in the refrigeration cycle, where the result is superheating. Superheating is the heating of vapor to a temperature much higher than the boiling point at the existing pressure. Superheating is also defined as the condition where the temperature of a vapor is greater than the saturation temperature corresponding to its pressure (Dossat, R. J. (1997) Principles of Refrigeration, $4^{th}$ ed., Prentice-Hall International, Inc., p. 108, 120–123). Heat is initially absorbed in the evaporator. The vaporized refrigerant can continue to absorb heat before it reaches the compressor. Further heat is absorbed by the refrigerant during compression, such that superheated gaseous refrigerant is produced. Superheating in a refrigeration system has a number of adverse consequences, as revealed below.

Adverse Effects of Superheated Gas and Advantages of Desuperheating.

One adverse consequence of superheated gas is that contact of the superheated gas with a water-cooled condenser can result in excessive heating of the water within the condenser, with consequent undesirable deposit of scale (scaling). Water used in the condenser normally contains calcium bicarbonate, which is water-soluble. However, excess heating provokes the conversion of the calcium bicarbonate to calcium carbonate, which forms a water-insoluble deposit in the condenser (Demko et al, U.S. Pat. No. 5,509,462, issued Apr. 23, 1996; Pauling, L. (1970) General Chemistry, Dover Publications, N.Y., p. 504).

Another adverse consequence of passage of superheated gas through the refrigeration system is that it results in excessive expansion of the gaseous refrigerant. The result of this excessive expansion is that the compressor must compress a correspondingly greater volume of gas during passage of the refrigerant through the system (Dossat, R. J. (1997) Principles of Refrigeration, $4^{th}$ ed., Prentice-Hall International, Inc., p. 120). A result of this need for an increased amount of compression is the utilization of extra power (Stoecker, W. F. (1998) Industrial Refrigeration Handbook, McGraw-Hill, New York, p. 72).

Oil from the compressor can mix with the refrigerant, resulting in the drawing of oil throughout the system, and in undesirable oil deposits in the condenser and evaporator. Oil in the evaporator can cause considerable loss of evaporator efficiency (Dossat, R. J. (1997) Principles of Refrigeration, $4^{th}$ ed., Prentice-Hall International, Inc., p. 322–323). Another undesirable effect is loss and depletion of oil in the compressor. The undesirable effects of contaminating oil can be prevented by means of an oil separator. Oil separators are described below. Separation of the oil from the gaseous refrigerant is difficult when the mixture is relatively hot, but is easier when the mixture is relatively cool. Hence, a desupetheater can be used to cool the hot discharge gas at or prior to the position where the hot discharge gas enters the oil separator.

A further disadvantage of introducing superheated gas into the condenser is that it can result in inefficient wetting of the surface of the condenser, with consequent inefficient heat transfer (U.S. Pat. No. 1,946,328 issued to J. Neff). Hence, an advantage of desuperheating is more efficient heat transfer in the condenser.

In summary, desuperheating of hot discharge gas, prior to contact with parts of the refrigeration system downstream of the compressor might be expected to solve a number of problems, including: (1) scaling as a result of hot discharge gas in a watercooled condenser; (2) expansion of gas with the consequent need for excess power consumption due to extra work performed by the compressor, (3) utilization of heat, derived from a desuperheater, to improve the performance of oil separation devices, and (4) more efficient heat transfer in the condenser.

Desuperheaters

Some prior art desuperheaters use steam, while others describe desuperheaters that use refrigerant.

U.S. Pat. No. 4,454,720 issued to H. M. Leibowitz describes a heat pump for recovering energy from waste fluid, wherein a desuperheater sprays atomized liquid water into a flow of superheated steam.

U.S. Pat. No. 5,041,246 issued to F. E. Garrison describes a venturi for use in desuperheating in a steam generator.

U.S. Pat. No. 3,343,375 issued to L. K. Quick describes a desuperheater wherein only a portion of the superheated hot discharge gas is desuperheated. The superheated gas that leaves the compressor at output 12 and sent through line 71 is desuperheated, but the portion leaving at output 12 and sent through line 13 is not desuperheated.

U.S. Pat. No. 4,311,498 issued to D. K. Miller describes a desuperheater wherein hot discharge gas is desuperheated by coils 32 containing mechanically circulated water.

U.S. Pat. No. 5,336,451 issued to J. M. Lovick relates to the desuperheating of steam by the injection of cool water.

U.S. Pat. No. 1,946,328 issued to J. Neff describes a desuperheater for a refrigeration system wherein the desuperheater comprises a pump for actively driving cool liquid refrigerant to be used for desuperheating purposes.

U.S. Pat. No. 4,554,799 issued to F. T. Pallanch relates to the problem of compressing gaseous refrigerant, where the gas is expanded to such a great degree that multiple compressors are needed. A desuperheater is placed in the line between two successive compressors in order to improve the efficiency of the second compressor. Cool liquid refrigerant is not mixed with the superheated gas. Instead, cooling is by means of a heat exchanger. The preferred mode of delivery of the cool liquid refrigerant is a mechanical pump.

U.S. Pat. No. 4,311,498 issued to D. K. Miller describes a refrigeration system having a desuperheater positioned between the compressor and condenser, where the desuperheater is comprised of a line 34 containing circulating cold water (column 3, lines 34–36). The water appears to be circulated by means of a mechanical pump.

U.S. Pat. No. 5,150,580 issued to R. E. Hyde describes a desuperheater wherein cool liquid refrigerant leaving the condenser is actively injected into the condenser with a mechanical pump (column 6, lines 61–63). Desuperheating occurs in the condenser, and not in any portion of a line upstream to the condenser (column 6, lines 66–69).

U.S. Pat. No. 4,419,865 issued to P. G. Szymaszek describes a desuperheater wherein cool liquid refrigerant leaving the condenser is actively injected at a point in between the compressor and an oil separator using a pump 22 and motor 23.

U.S. Pat. No. 5,097,677 issued to M. T. Holtzapple describes a desuperheater where cool liquid refrigerant is introduced into the compressor, rather than at a point after the compressor. Holtzapple uses a capillary wick for introducing cool liquid refrigerant.

Other desuperheaters known in the art use booster pumps to introduce cool liquid refrigerant in order to accomplish desuperheating (Sandofsky, M. Store Equipment and Design. August 1997, p. 37). The use of a booster pump indicates that the desuperheater uses an active process for driving the desuperheater separate from the compressor used to drive the refrigeration system.

Receivers

The receiver serves as a reservoir for cool liquid refrigerant. Cool liquid refrigerant exiting from the condenser may be introduced directly into the receiver, and stored for later use in the evaporator. When the amount of gas being condensed is higher than that required by the load (the load at the evaporator), the extra condensed liquid must remain in the receiver. Conversely, if the load is increased (the load at the evaporator), more liquid than is being condensed is needed by the evaporator, and this extra liquid can be taken from that stored in the receiver. Typically, these imbalances last only a short time.

Ares, et al. described two types of prior art receivers, a flow-through receiver and a surge receiver (U.S. Pat. No. 4,621,505). In a flow-through receiver, the conduit connecting the condenser to the receiver is connected to the top of the receiver, so that all of the condensate is discharged directly into the receiver.

In a surge receiver, a pipe from the condenser passes below the receiver to the evaporator, wherein a T-joint protrudes upwards into the lower portion of the receiver, and allows the flow of liquid refrigerant into and out of the receiver (U.S. Pat. No. 4,506,523, issued to L. J. DiCarlo, et al.). The result is a stratification of liquid inside the receiver according to temperature (U.S. Pat. No. 4,621,505, column 5, lines 9–39).

A disadvantage of prior art receivers is that an overproduction of subcooled liquid can occur, with resultant "logging" of the receiver. A related problem in prior art condensers is "starving" of the evaporator. "Logging" means that too much liquid refrigerant is in the receiver as compared to the amount of gaseous refrigerant in the receiver. In other words, with maximal logging, the receiver contains little or no gaseous refrigerant. Logging is a problem with cool ambient temperatures (at night; in the winter). With cool ambient temperatures, the condensing pressure drops. "Starvation" of the evaporator means that the evaporator is not receiving liquid refrigerant in the amount needed to satisfy the load on the evaporator.

The prior art has attempted to reduce or prevent logging by flooding refrigerant into the condenser. Two different methods have been used in the prior art to prevent logging. In the first method, flooding of the condenser is accomplished by shutting down the condenser fan. Shutting down the condenser fan results in an increase in condensing temperature. Consequently, starvation of the evaporator is prevented. A problem with this method is that optimal efficiency of the refrigeration system is not obtained.

In the second method, flooding of the condenser can be accomplished by closing or shutting down a valve at the outlet of the condenser (U.S. Pat. No. 4,621,505 issued to R. A. Ares, et al.). The desired effect is flooding of the condenser, but an undesirable result of this is "starving" of the evaporator. To solve the problem of "starving," some prior art refrigeration systems restrict or close the valve at the outlet of the condenser, while at the same time introducing hot discharge gas at the top of the receiver. This hot discharge gas pressurizes the receiver, so that the expansion valve is no longer starved. When the hot discharge gas pressurizes the receiver, liquid refrigerant in the receiver is forced to exit and be transmitted to the evaporator.

A problem with the method of introducing hot discharge gas into the receiver is that optimal efficiency of the refrigeration system is not obtained. The problem is that, although the hot discharge gas pressurizes the receiver (as desired), it also has the effect of heating the liquid refrigerant in the receiver (which is not desired), and thus also has the effect of heating the liquid refrigerant that is sent to the evaporator, thereby reducing its efficiency.

Oil Separators

U.S. Pat. No. 4,506,523 issued to L. J. DeCarlo, et al. describes an oil separator that contains a centrifugal vortex. This patent points out a problem in oil separators, namely, "the cooling of separated oil below the condensing temperature of the gas refrigerant frequently produced excessive refrigerant condensation in and dilution of the oil." (column 1, lines 50–53). DeCarlo, et al. attempt to resolve this problem by use of "a series of baffle or deflector plates . . . thereby assisting in . . . enhancing final separation of refrigerant vapor . . ." (column 5, lines 46–54). The device in DeCarlo, et al.'s patent contains an oil reservoir, but this reservoir does not contain a heater (where the heating prevents refrigerant vapor from condensing in the oil).

U.S. Pat. No. 4,311,498 issued to D. K. Miller describes an oil separator means, wherein hot discharge gas is desuperheated by coils 32 containing mechanically circulated water, wherein oil accumulates in the lower portion of the desuperheater 30, from which it is sent to the compressor (column 4, lines 4–15). The oil separator contains no means to heat the separated oil.

Defrosters

Defrosting has been accomplished by means of: (1) electric defrosters; (2) by mixing superheated gas and desuperheated gas (from the top portion of the reservoir), and sending the mixture through the evaporator; and (3) by mixing superheated gas and cool liquid refrigerant and directing the mixture to the evaporator (U.S. Pat. No. 3,343,375 issued to L. K. Quick).

A disadvantage of using straight superheated gas for defrosting is that extreme ranges of expansion and contraction can cause breakage and leaks in the refrigeration system's lines or tubing. A disadvantage of using a mixture of superheated gas and desuperheated gas (acquired from the upper portion of the reservoir) is that this gas in the upper portion of the receiver is in limited supply. Note that the shortage of this gas is especially severe during "logging" of the receiver.

U.S. Pat. No. 5,934,297 issued to P. J. Wolff, et al. and U.S. Pat. No. 5,921,092 issued to J. A. Bahr et al describe a prior art electric defroster, where defrosting is effected by an electric heater, and not by means of hot gas.

U.S. Pat. No. 4,506,523 issued to L. J. DeCarlo, et al. describes a defroster where superheated gas is mixed with cool gas from the upper portion of the receiver.

U.S. Pat. No. 3,343,375 issued to L. K. Quick describes a defroster where a mixture of superheated gas with liquid refrigerant (from the lower portion of the receiver) is used.

U.S. Pat. No. 4,621,505 issued to R. A. Ares, et al. describes a defroster where cool gas from the upper portion of the receiver (and not mixed with hot gas) is used for defrosting (column 4, lines 2–8).

SUMMARY OF THE INVENTION

The present invention relates to the addition of desuperheating to the prior art three step refrigeration system. According to the invention the sequence becomes: (1) expansion and evaporation; (2) compression; (3) desuperheating; and (4) condensation.

The passive desuperheater of the invention comprises an inlet for superheated gas, an inlet for cool liquid refrigerant, a chamber where the superheated gas and cool liquid refrigerant contact and mix with each other, and an outlet for the desuperheated gas. In one embodiment, the superheated gas moves in an essentially straight stream, during which it is desuperheated. In another embodiment, the superheated gas moves through three nested containers, during which desuperheating occurs, removal of contaminating oil occurs, and the removed oil is heated by incoming superheated gas.

In another embodiment of the passive desuperheater, all of the superheated gas is directed into the receiver and released into the lower portion of the receiver, that is, that portion of the receiver which contains a store of cool liquid refrigerant. In this embodiment, all of the superheated gas moves through the cool liquid refrigerant within the receiver, where it is desuperheated. After rising through the cool liquid refrigerant, the gas enters the upper portion of the receiver (that portion containing only gas or vapor), and finally exits via a pipe connected to the condenser.

In a related embodiment, superheated gas is transmitted through a pipe positioned in the receiver where passage of the superheated gas through the pipe results in heat transfer through the wall of the pipe to the surrounding cool liquid refrigerant in the receiver (resulting in desuperheating), and where the desuperheated gas is released into the upper portion of the receiver at the open end of the pipe. Once released into the upper portion of the receiver, the desuperheated gas is free to exit the receiver through a line in communication with the condenser.

In another embodiment, the superheated gas travels through a closed line in the the receiver where passage of the superheated gas through the line results in heat transfer through the wall of the line to the surrounding cool liquid refrigerant in the receiver (resulting in desuperheating), and where the desuperheated gas traveling through the closed line is directed out of the receiver, and to the condenser. A separate line leads from the upper portion of the receiver to the condenser inlet.

A further embodiment of the desuperheater utilizes a shell and tube condenser. In this desuperheater, superheated gas enters the shell and tube condenser through a port located at or near the bottom of the condenser. The desuperheater comprises a narrow diameter pipe, which receives superheated gas, and a wide diameter pipe fitted over the narrow diameter pipe. The end region of the wide pipe fits loosely over the end region of the narrow pipe. The region of overlap, which involves a loose fit, allows limited entry of cool liquid refrigerant into the stream of the superheated gas. Upon limited entry of the cool liquid, and mixing with the stream of superheated gas, the superheated gas becomes desuperheated. Desuperheated gas is released at the far end of the wide pipe, where it enters the upper portion of the shell and tube condenser. All of this desuperheated gas eventually condenses in the shell and tube condenser. A line leads from the lower portion of the condenser and allows cool liquid refrigerant to flow to the evaporator.

In another alternative embodiment, the receiver may take the form of a true surge receiver. The true surge receiver comprises a receiver having a minimum subcooling valve (MSV) occurring in the line leading from the condenser outlet to the receiver. The true surge receiver further comprises a T-joint downstream of the condenser outlet and upstream of the MSV. The T-joint leads to three lines leading, respectively, to: (1) the condenser outlet; (2) the evaporator; and (3) the minimum subcooling valve (MSV). The MSV can close and block the flow of cool liquid refrigerant to the receiver, resulting in an increased flow of cool liquid refrigerant to the evaporator. The MSV can open and increase the flow of cool liquid refrigerant to the receiver. The MSV comprises a sensor which monitors the pressure and temperature of the condensed liquid in the condenser.

Broadly stated, the present invention comprises a passive desuperheater comprising a chamber having a first inlet for receiving said superheated gas, a second inlet for receiving cooler liquid refrigerant condensed by said condenser, said second inlet positioned below the outlet of said condenser to cause said liquid refrigerant to flow to said second inlet by the force of gravity, and an outlet that outputs said desuperheated gas for transmitting to said condenser, wherein said liquid refrigerant is caused to be mixed with said superheated gas in said chamber to reduce the temperature of said gas at said outlet.

It is therefore an object of the present invention is to decrease the formation of scale within the condenser.

A further object is to decrease oil contamination of the condenser, evaporator, and other parts of the vapor compression refrigeration system as a result of oil in the refrigerant. A related object of the invention is to prevent re-deposit of refrigerant in the separated oil, after initial separation of the oil and the refrigerant.

Still another object of the invention is to supply a mixture of desuperheated gas and cool gas, for use in defrosting the evaporator, while avoiding the following problems: (1) the excessive expansion and contraction of pipes that can occur with defrosters that are supplied with only superheated gas, and (2) the limited supply of cool gas which occurs in defrosters which draw their supply of cool gas from the upper portion of the receiver.

Yet another object of the invention is to improve the efficiency of refrigeration and air conditioning systems. More specifically, it is an object of this invention to drive the flow of cool liquid refrigerant into the mixing chamber of the discharge desuperheater without use of an external mechanical pump, a venturi pump, or a jet pump. Accordingly, it is an object of the invention that the force that draws cool liquid refrigerant into the mixing chamber of the discharge desuperheater results primarily from the use of gravity.

Another object of the invention is to provide simultaneous desuperheating to all of the hot discharge gas, rather than to provide desuperheating to only a portion of the hot discharge gas.

A further goal of the invention is to reduce "logging" of the receiver, and to prevent "starving" of the evaporator under low condensing temperature conditions.

DETAILED DESCRIPTION OF THE INVENTION

Figure 1:
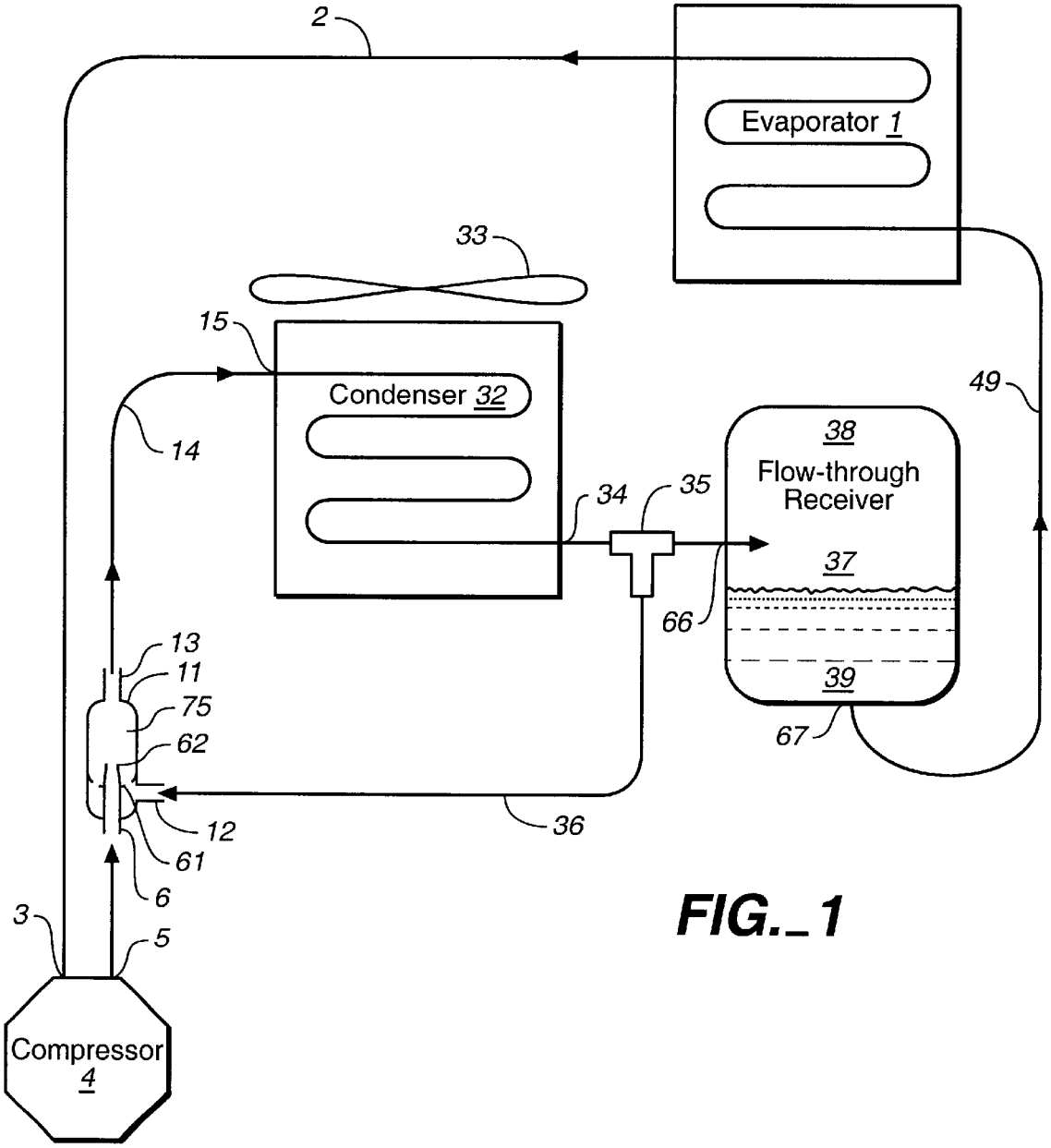
FIG. 1 is a refrigeration system with a discharge desuperheater according to the present invention, where flow of the cool liquid refrigerant into the hot discharge gas is provided by the force of gravity.

Typical refrigeration systems are closed systems, that is, the evaporator, compressor, condenser, and optional receiver, as well as the lines and valves included in the system, are closed and not open to the atmosphere. In the following descriptions, it will be understood that an expansion device is also typically included immediately upstream of, or is included as part of the evaporator, in a conventional refrigeration system or air conditioner. The definitions below will be followed by detailed descriptions of the various embodiments of the present invention.

Compressor. The compressor converts gaseous refrigerant acquired from the evaporator and converts it into pressurized gaseous refrigerant. The gaseous refrigerant acquired from the evaporator may or may not be superheated. The compressor adds further heat, resulting in superheating or further superheating. The compressor comprises a gas inlet and a gas outlet. The gas outlet may be followed by a check valve or by a U-drop, for preventing backflow of cooler liquid refrigerant into the compressor. The U-drop comprises pipe or line that extends from the compressor outlet to below the level of the compressor, forms a U-turn, and then extends upwards to the level or upwards beyond the level of the outlet of the compressor.

Condenser. The condenser may take the form of an evaporative condenser or a shell and tube condenser. The condenser may be air cooled or water cooled. A refrigeration system having an evaporative condenser may have a separate receiver, however in a refrigeration system with a shell and tube condenser, the shell and tube condenser serves the function of a receiver. The condenser may have a fan for drawing air, thus promoting the condensation of the liquid refrigerant and/or the evaporation of water used if water is the condenser's coolant.

Desuperheated gas. A desuperheated gas is defined as a refrigerant gas that had previously been above the saturation temperature, and was subsequently brought to, or near to the saturation temperature. The saturation temperature is the temperature at which the gas condenses in the condenser.

DDS. Discharge desuperheater. The discharge desuperheater accomplishes cooling of the superheated discharge gas, by allowing cooler liquid refrigerant to enter the stream of superheated hot discharge gas originating from the compressor. The resulting mixture is comprised of desuperheated, gaseous refrigerant. The passive flow of cooler liquid refrigerant is generated by the force of Gravity. A typical gravity drop according to the present invention is approximately six feet, though a considerably greater distance may be used, the exact distance being determined by the characteristics of the system. The DDS is designed to provide enough drawing force to prevent backflow of liquid refrigerant away from the DDS.

To achieve expenditure of a minimal amount of energy from the compressor, the dimensions of the DDS are such that the superheated gas preferably enters the desuperheater chamber from the bottom and has an opening of nozzle that extends upward into the chamber a predetermined distance from the inlet or bottom surface of the chamber. This allows for the walls of the nozzle to be in contact with the liquid refrigerant in the chamber and thereby generate some cooling of the superheated discharge gas before it exits the nozzle and enters the chamber. The ratio of the diameter of the hot gas inlet to the nozzle diameter is also preferably 1/1. In an alternate embodiment, the ratio is in the range of 1.0 to 1.33, i.e., the nozzle mouth is slightly small than the inlet. Note that the ratio of [2.0]/[1.5]=1.33. In another preferred embodiment, the ratio is 1.14. In other words, the nozzle diameter is that at the opening where the gas exits into the mixing chamber of the DDS. Where the nozzle diameter in the DDS is slightly less than the inlet diameter, the goal is to prevent turbulence and to assure a straight line of gas flow from the nozzle to the desuperheater chamber outlet.

The goal of utilizing a DDS with physical dimensions that create the minimally required drawing force upon the liquid refrigerant is furthered or promoted by the following. The mixing of the hot discharge gas with liquid refrigerant within the DDS results in a net contraction (net reduction of volume) of the desuperheated gas.

An alternate embodiment of the discharge desuperheater (DDS) involves two pipes, closely but loosely inserted into each other, where the first pipe receives superheated discharge gas, and the second pipe takes away desuperheated gas. The diameter of the inlet pipe is slightly less than the diameter of the outlet pipe. The two loosely fitting pipes are surrounded by a closed cowl, wherein a secondary inlet is used to introduce the liquid refrigerant.

In refrigeration systems employing an oil separator, the DDS may be located at a point between the compressor and the oil separator, or at a point between the oil separator and the condenser. Preferably, the DDS is located at a point between the compressor and the oil separator, since the process of desuperheating may result in the production of large oil droplets (the oil separator can more easily remove large oil droplets from the discharge gas than small oil droplets).

DSC. Desuperheating condenser. The desuperheating condenser is a shell and tube type condenser, wherein desuperheating of the hot discharge gas occurs within the condenser. Superheated discharge gas enters the bottom of the condenser through a short, narrower conduit or pipe, where a long, wider pipe is fitted over the end of the short, narrower pipe. The flow of gaseous refrigerant continues through the short, narrower pipe and through the long, wider pipe. An opening at the top of the pipe allows desuperheated gas to enter the upper portion of the shell and tube condenser. The upper portion of the shell and tube receiver is defined as a region within the shell and tube receiver which is substantially filled with gaseous refrigerant, under normal operating conditions.

The region where the long, wider pipe is fitted over the short, narrower pipe allows passage and mixing of cool liquid refrigerant with the stream of hot discharge gas. Optimally, all of the cool liquid refrigerant that is drawn into the flow of hot discharge gas is vaporized.

The region where the short, narrower pipe and the long, wider pipe overlap each other may be situated within a depression in the bottom surface of the condenser, where this depression resembles a water well or a plumbing trap. The desuperheating condenser is a dry type desuperheater.

DOR. Distilling oil reservoir. Following separation of oil from the discharge gas in the DOS, the separated oil enters the DOR. The oil reservoir (DOR) may have a pipe or conduit running through it. This pipe allows passage of the superheated discharge gas through the oil reservoir. Transfer of some heat from the superheated discharge gas, into the oil reservoir serves to warm the oil and to prevent liquid refrigerant from condensing in with the oil.

DSR. Desuperheating surge receiver. The desuperheating surge receiver is a receiver having an inlet at or near the bottom of the receiver, which allows the introduction of all of the superheated discharge gas into the reservoir of cool liquid refrigerant. In prior art receivers, superheated gas from the compressor is introduced directly into the condenser. However, in the DSR, the superheated gas from the compressor is introduced, not at the condenser, but at the bottom of the receiver. Upon entering the reservoir and passing through the cool liquid refrigerant, the hot discharge gas is desuperheated. The discharge gas rises through the cool liquid refrigerant, and enters a gaseous head space, whereupon it leaves a line for the condenser.

DOS. Desuperheating oil scrubber. The DOS is a wet desuperheater. The DOS is comprised of three containers, which may be pipe-like or cylindrical, and which are nested within each other. These three pipes or containers have a small, middle, and wide diameter, respectively. Superheated gas (contaminated with oil) enters at the bottom of the DOS, where it travels up a centrally located small diameter pipe. The top of this pipe is open. Hot gas leaves the small diameter pipe, and enters the middle diameter container. The middle diameter pipe or container is closed at the top, so that gas must flow downwards, where the downward flow occurs outside of the small diameter pipe, and within the middle diameter pipe. Once in the middle diameter pipe, the hot gas travels downwards, whereupon the hot gas enters the openings that lead to the wide diameter pipe. The wide diameter pipe contains a pool of cool liquid refrigerant.

The term "scrubbing" can be used to describe the following process of removal of oil from the hot discharge gas. The contact and mixture of the superheated discharge gas with the cool liquid refrigerant provokes the formation of large oil droplets, which drop to the bottom of the middle diameter pipe, to be sent back to the compressor. Hot discharge gas entering the small diameter pipe contains oil dispersed in the gas. With entry into the middle diameter pipe, the hot discharge gas meets cool liquid refrigerant. An array of holes in the middle diameter pipe allows the cool liquid refrigerant to contact or mix with the hot discharge gas. Contact with the cool liquid refrigerant provokes the oil to dissolve in the liquid refrigerant. As the oil dissolved in the liquid refrigerant sinks downwards, the oil is heated by the superheated hot discharge gas in the small diameter pipe, and this heating provokes the formation of a relatively purified oil. The relatively purified oil is removed from the bottom of the middle diameter pipe by a line, which leads back to the compressor.

The DOS also utilizes a valve or a restriction point for regulating the flow of relatively pure oil from the oil scrubber back to the compressor.

Hence, the DOS accomplishes: (1) removal of the oil; (2) heating of the removed oil to prevent condensation of gaseous refrigerant in the removed oil; and (3) desuperheating of the gaseous refrigerant.

Dry desuperheating. Dry desuperheating refers to a desuperheater or desuperheating process, where cool liquid refrigerant is injected directly in the hot, superheated discharge gas.

FSC. Floating setpoint control. The FSC measures the condensing ambient temperature and the temperature of the condensed liquid leaving the condenser. The difference in these two temperatures determines the speed of the condensing fan.

Flooding of the compressor. Compressor shut-down can have the undesirable effect of flooding of the compressor with liquid refrigerant. A U-drop may be installed in the line between the condenser and compressor to prevent this flooding. The U-drop is comprised of the line used to introduce refrigerant into the condenser, where the following configuration occurs upstream of the condenser. The line extends downwards for a distance of preferably six feet or more, then upwards for a distance of preferably six feet or more, followed by connection to the compressor. An alternative to the U-drop is a check valve. An alternative to the U-drop and check valve is to have the condenser situated at a level below the compressor.

Gas-gas defrost valve (G-G defrost valve). The gas-gas defrost valve allows mixing of superheated discharge gas with desuperheated discharge gas, to produce a gas of an intermediate temperature for use in defrosting the evaporator. A desirable intermediate temperature may be 90° F. The G-G defrost valve can be used with any type of passive desuperheating process, including a DDS, DOS, DSR, and IDR. Regardless of the condensing temperature, the G-G defrost valve is able to supply a defrosting gas at the fixed temperature, preferably 90° F.

IDR. Indirect desuperheating receiver. The indirect desuperheating receiver is a dry desuperheater, comprised of a pipe running through the bottom of the receiver. Hot, superheated, discharge gas from the compressor is introduced into one end of the pipe, flows through the pipe, and exits as a desuperheated gas. The cool liquid refrigerant cools the pipe, resulting in desuperheating of the gas within the pipe. (The cool liquid refrigerant does not mix with the superheated gas during passage through the pipe.) After passage through the cool liquid refrigerant at or near the bottom of the receiver, the desuperheated gas is then sent via a line to the entry point of the condenser.

The IDR has two embodiments. In the first embodiment, the pipe leading from the bottom of the receiver empties at the top portion of the receiver, thus allowing all of the desuperheated gas to mix with the gas in the top portion of the receiver. An exit point in the top portion of the receiver directs desuperheated gas through a line to the entry point of the condenser. In the second embodiment, the pipe leading from the bottom of the receiver exits the receiver in the upper portion of the receiver, and is sent via a line to the entry point of the condenser. In the second embodiment, another line exits the top portion of the receiver and allows passage of gas from the top portion of the receiver to the entry point of the condenser. In both embodiments, all of the superheated hot discharge gas passes within a pipe that passes through the lower portion of the receiver, thus cooling the hot discharge gas. The lower portion of the receiver is defined as that part of the receiver which is substantially filled with liquid refrigerant, under normal operating conditions.

MSV. Minimum subcooling valve. The MSV is a valve that serves a regulatory function. The MSV maintains the proportion of cool liquid refrigerant from the condenser that goes to the evaporator or to the receiver (the true surge receiver; TSR). By definition, a true surge receiver is a receiver whose contents is controlled by the MSV. A goal of the MSV is to maintain subcooling of the liquid refrigerant leaving the condenser, and to maintain this subcooling at a minimally subcooled level. An advantage of maintaining liquid refrigerant at a subcooled temperature is to prevent the formation of flash gas.

The MSV uses a sensor to determine the temperature of the cool refrigerant exiting the condenser and the temperature of the desuperheated gas exiting from the desuperheater (in a desuperheating surge receiver). Alternatively, the MSV can use sensors to determine both the temperature and pressure of the cool refrigerant exiting from the condenser. In this configuration, the MSV measures the temperature and pressure at one point. Closing of the MSV floods the condenser, and increases subcooling. Opening of the MSV drains the condenser and decreases subcooling. When more liquid refrigerant is coming out of the condenser than is required by the evaporator, the MSV opens, and allows liquid refrigerant to flow into the true surge receiver.

Flooding of the condenser results in a decrease in the amount of compressed vapor in the condenser, where the result is a decrease in the amount of compressed vapor being converted into liquid, and hence a increase in the rate of production of subcooled liquid.

In its preferred embodiment, the MSV is positioned downstream from the line leading from the exiting from the receiver, and upstream from the line that delivers condensed refrigerant into the receiver. A T-pipe or T-joint occurs in between the condenser outlet and the MSV. The T-pipe interconnects lines leading to or from three structures: (1) the condenser; (2) the evaporator, and (3) the receiver. When the MSV is closed, the cool liquid refrigerant from the condenser goes directly to the evaporator. When the MSV is open, the cool liquid from the condenser flows into the receiver. A minimum pressure valve may occur in the line going from the MSV to the receiver. The MSV has a probe which may monitor the temperature and pressure of refrigerant in the condenser.

In an alternate embodiment, the MSV is positioned in the line extending from the upper portion of the receiver to the entry point of the condenser. In this less preferred embodiment, a line extends from the exit point of the condenser to a check valve, and from the check valve to the receiver. A T-pipe occurs in this line (prior to the check valve), which directs cool liquid refrigerant to the evaporator.

The MSV may be used in conjunction with an additional valve (the minimum pressure valve; MPV). When the minimum pressure valve takes control, the MSV goes to the full open position. With this configuration, the condenser floods as needed to maintain the minimum head pressure.

The MSV can be used in refrigeration systems comprising a desuperheating surge receiver (DSR), a discharge desuperheater (DDS), a desuperheating oil separator (DOS), a centrifugal oil separator, and an indirect desuperheating receiver (IDR). The MSV is useful when any of these separate desuperheaters are used in the refrigeration system. We define a receiver as a true surge receiver, where the receiver is used in a refrigeration system containing a MSV.

Mechanical Minimum Subcooling Valve (mechanical MSV). The invention may use an electronic MSV or a mechanical MSV. The mechanical MSV can be produced by modifications of a prior art valve, namely, a Sporlan type V thermostatic expansion valve. The Sporlan type V valve works by depressing the pin, resulting in a downward movement of the plug, thereby allowing the flow of fluid from the entry port to the exit port. One embodiment of the mechanical MSV is the "method one" MSV. The "method one" mechanical MSV is produced by widening the opening of the seat, for example by drilling, and by using a narrower spring. The "method one" valve operates by pulling the pin up, thus allowing the flow of fluid from the entry port to the exit port. When in the full open position, the "method one" valve has a greater opening than that of the prior art Sporlan type V valve.

Another embodiment of the MSV is the "method two" MSV. The "method two" mechanical MSV is produced as for the "method one" valve, except that the "method two" valve also contains a conduit leading from the stem, wherein the stem has a bleed hole and a pressure differential check valve. This pressure differential check valve may take the form of Sporlan's KS-XTT-1 pilot differential valve. Sporlan's KS-XTT-1 pilot differential valve is a replacement part for Sporlan's OLDR-15 valve.

Oil separator (centrifugal oil separator). The oil separator accomplishes separation of the gaseous refrigerant and oil by means of a vortex or centrifuge. The oil separator can be used in conjunction with the DOR (distilling oil reservoir). This reservoir (DOR) collects the cool oil coming from the oil separator and, once collected, allows transfer of the collected oil back to the compressor. To prevent any refrigerant from mixing with the collected oil, the oil in the DOR is heated by means of a pipe running through it, where the pipe contains superheated discharge gas (this superheated discharge gas does not directly contact the oil in the DOR).

Passive desuperheating. Passive desuperheating refers to a desuperheater, or desuperheating process, wherein no extra energy is directly utilized to accomplish desuperheating. In contrast, active desuperheating make use of a booster pump, motorized pump, venturi pump, or jet pump for the forcible introduction of cool liquid refrigerant or cool gaseous refrigerant into the superheated hot discharge gas.

Passive desuperheating can be accomplished according to the present invention by various means, including directing all of the superheated hot discharge gas into: (1) a discharge desuperheater; (2) a desuperheating oil scrubber; (3) a desuperheating oil separator (oil separator+discharge desuperheater); (4) a desuperheating receiver, (5) an indirect desuperheating receiver; or (6) a desuperheating condenser.

True surge receiver. Prior art receivers are flow-through receivers and surge receivers. These prior art receivers occur at a point between the condenser and evaporator. In contrast, a true surge receiver according to the present invention is positioned between the compressor and condenser. A true surge receiver (TSR) contains an MSV.

An imbalance can occur where additional cool liquid refrigerant is needed by the evaporator. The additional liquid refrigerant can be supplied by the liquid in the receiver, but further so by an increase in the rate of flow of superheated hot discharge gas into the bottom of the true surge receiver (followed by exit of desuperheated gas from the top of the receiver, and shunting to the condenser).

Restriction. Restriction is defined as the situation where a fluid flows through a pipe, and where the pressure of the fluid at the pipe's outlet is greater than the pressure of the fluid at the pipe's inlet. The term "restriction" is relevant to the structure and function of the discharge desuperheater.

Shell and tube condenser. In a shell and tube condenser, cool water enters the condenser through a tube or pipe, wherein the pipe contains a number of bends or coils, and then exits near the top of the condenser. The region of the shell and tube condenser surrounding the pipe contains refrigerant. Gaseous refrigerant is directed into the upper part of the condenser, and condensed (liquid) refrigerant forms and accumulates in the lower part of the condenser.

Wet desuperheating. Wet desuperheating refers to a desuperheater or desuperheating process, where superheated discharge gas is piped into the lower portion of the receiver, and comes into direct contact with the cool liquid in the lower portion of the receiver. The gas then passes through the partially filled, or flooded and substantially filled receiver, wherein desuperheating occurs. The desuperheated gas then exits at the upper portion of the receiver of the receiver, where it then travels to the condenser. Wet desuperheating also refers to a desuperheater or desuperheating process, where superheated gas is piped into the distilling oil scrubber (DOS).

An embodiment according to the present invention, comprising a discharge desuperheater and an evaporative condenser, is shown (FIG. 1). Expanded, heated gaseous refrigerant leaves evaporator 1, travels through a line 2 to the entry point 3 of the compressor 4. Pressurized, gaseous refrigerant leaves the compressor at 5, and at entry point 6, enters the discharge desuperheater 11. Cool liquid refrigerant from the condenser 32 travels through the T-pipe 35 through line 36 to the entry point 12 of the discharge desuperheater 11. In an alternative embodiment, cool liquid refrigerant from a line (not shown) exiting from the lower portion of the receiver 37, travels to entry point 12 of the discharge desuperheater 11. It will be obvious and apparent to one skilled in the art, that cool liquid refrigerant for use in the discharge desuperheating may by taken from a number of points downstream of the outlet of the condenser, and upstream of the evaporator.

Desuperheated gas leaves the desuperheater at point 13, travels through line 14 to the entry point 15 of the condenser 32. Condenser 32 preferably includes a cooling fan 33. Water can also be pumped through condenser 32 to promote condensation of the refrigerant. Cool liquid refrigerant exits the condenser at point 34, travels through the T-pipe 35, and at point 66 enters the receiver 37. The receiver 37 shown in FIG. 1 is a flow-through receiver and is optional in many systems. The receiver 37 comprises a top or upper portion 38, defined as that portion which contains gas under normal operating conditions, and a lower portion 39, defined as that portion which contains condensed liquid under normal operating conditions. Cool liquid refrigerant exits the receiver at point 67, and travels through line 49 to the evaporator 1 (FIG. 1). An alternate embodiment can include a gas-gas defrost valve 26. A fan 33 draws air through the condenser.

Figure 2:
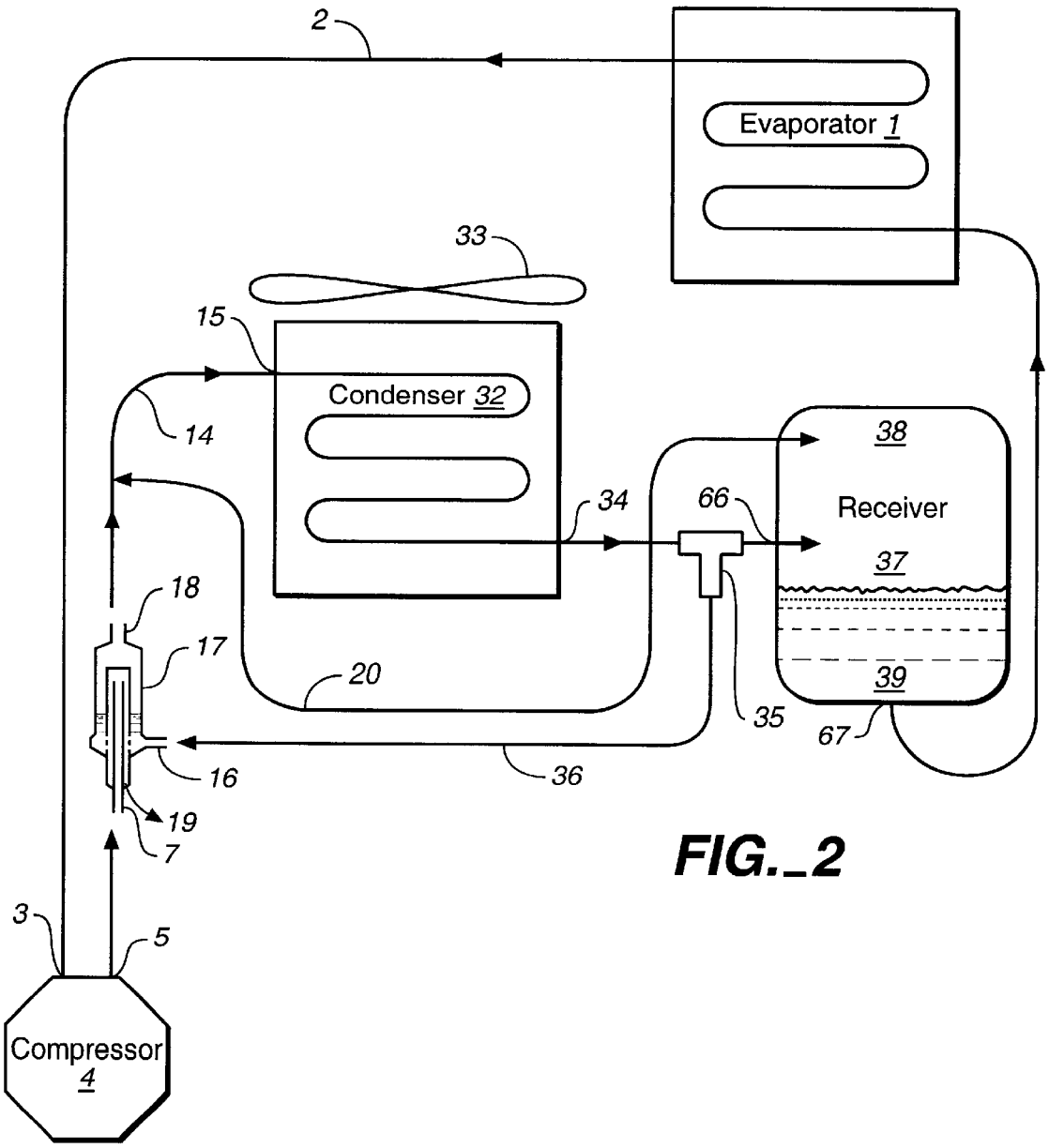
FIG. 2 is a refrigeration system according to the present invention including a desuperheating oil scrubber (DOS).

An embodiment of the present invention featuring a desuperheating oil scrubber is shown (FIG. 2). Gas from the evaporator 1 travels through line 2 to the entry point 3 of the compressor 4. Superheated hot discharge gas leaves the compressor at point 5, and travels to the entry point 7 of the desuperheating oil scrubber. Cool liquid refrigerant from the condenser travels from the T-pipe 35 through line 36, where it enters at point 16 into the desuperheating oil scrubber 17. Desuperheated gas leaves the oil scrubber at point 18, travels through line 14 to the entry point 15 of the condenser 32.

An equalizing line 20 maintains an equal pressure between the gas in line 14 and the gas in the upper portion 38 of the receiver 37.

Condensed liquid refrigerant leaves the condenser at point 34, and travels through the T-pipe 35 to the entry point 66, and enters the receiver 37. Cool liquid refrigerant leaves at exit point 67, and travels through line 49 to the evaporator 1.

In an alternate embodiment, cool liquid refrigerant can be supplied to the desuperheating oil scrubber via a line exiting from the lower portion of the receiver (rather than from the T-pipe 35) to provide cool liquid refrigerant to the desuperheating oil scrubber.

An alternate embodiment can also include a gas-gas defrost valve and/or a desuperheating condenser.

Figure 3:
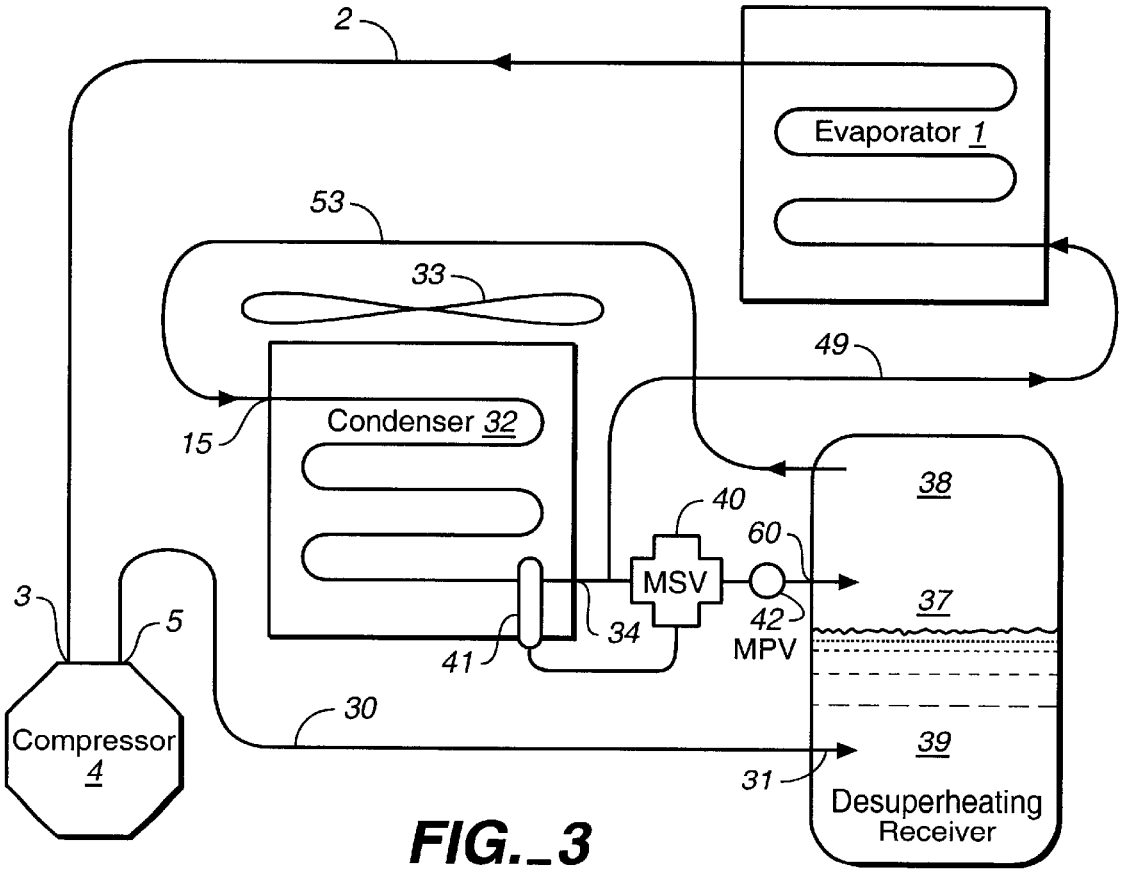
FIG. 3 is a refrigeration system with a desuperheating receiver according to the present invention, where the desuperheating receiver is a true surge receiver, i.e., it includes a minimum subcooling valve (MSV) and a T-joint, where the T-joint has leads that connect to the condenser outlet, the evaporator, and the MSV.

An embodiment of the present invention featuring a desuperheating receiver is shown (FIG. 3). The desuperheating receiver is a true surge receiver, because it comprises a minimum subcooling valve (MSV). Gas from the evaporator 1 travels through line 2 to the entry point 3 of the compressor 4. Superheated hot discharge gas leaves at point 5, and travels through line 30, where the gas exits at point 31. The gas rises through the lower portion 39 of the receiver, becomes desuperheated, exits from the upper portion 38, and travels through line 53 to the entry point 15 of the condenser 32. Condensed cool liquid leaves the condenser at point 34. The cool liquid refrigerant may either travel through line 49 to the evaporator 1, or travel through the MSV 40 and MPV 42 to the entry point 66 of the receiver 37. The MPV 42 is an optional feature of the true surge receiver. A probe 41 is part of the MSV 40.

Figure 4:
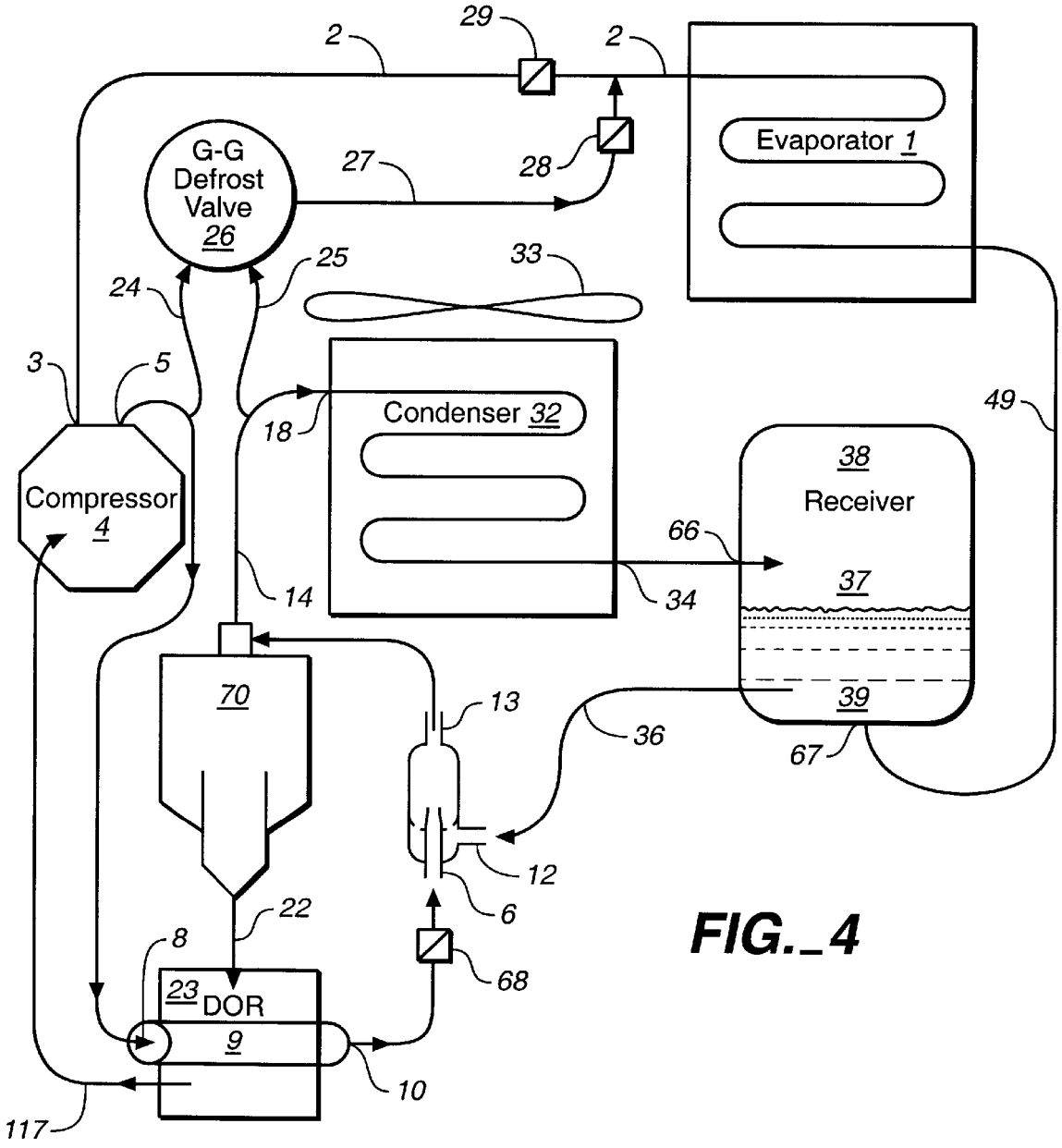
FIG. 4 is a refrigeration system according to the present invention including with a centrifugal oil separator, a distilling oil reservoir (DOR), and a discharge desuperheater (DDS). A gas-gas defrost valve is also shown.

An embodiment of the present invention featuring a centrifugal oil separator, distilling oil reservoir (DOR), discharge desuperheater, and gas-gas defrost valve is shown (FIG. 4). Gas leaving from, the evaporator 1 travels through line 2 to the entry point 3 of the compressor 4. Superheated hot discharge gas leaves at point 5, and travels to the entry point 8 of the pipe 9. Pipe 9 travels through the distilling oil reservoir 23, serves to transfer heat to the purified oil, and to some extend desuperheats the hot discharge gas. Superheated gas leaving at point 10 travels through valve 68 to the entry point 6 of the discharge desuperheater 11. Desuperheated gas exits at point 13, and travels to the centrifugal oil separator 70. Purified oil leaves through line 22, enters the distilling oil reservoir 23, and travels through line 117 to the compressor 4.

Desuperheated, purified gas travels through line 14 to the entry point 18 of the condenser 32.

A gas-gas defrost valve 26 receives superheated gas through line 24, desuperheated gas through line 25, and mixes these gases to acquire a gas of a desired temperature. Gas of the desired temperature leaves through line 27, passes through valve 28 to the evaporator 1. When the evaporator 1 is in a cooling mode, valve 29 is open while valve 28 is closed. When the evaporator 1 is being defrosted, valve 28 is open, while valve 29 is closed.

Condensed cool liquid refrigerant leaves the condenser at point 34, and at point 66 enters the receiver 37. Cool liquid refrigerant leaves the receiver 67, and travels through line 49 to the evaporator 1.

FIG. 4 shows cool liquid refrigerant exiting at the lower portion 39 of the receiver, and traveling through a line 36 to the entry point 12 of the discharge desuperheater 11. In an alternate embodiment, the source of cool liquid refrigerant is a T-pipe 35. An alternate embodiment may supply cool liquid refrigerant from a point exiting from any location between points 34 and 67.

Figure 5:
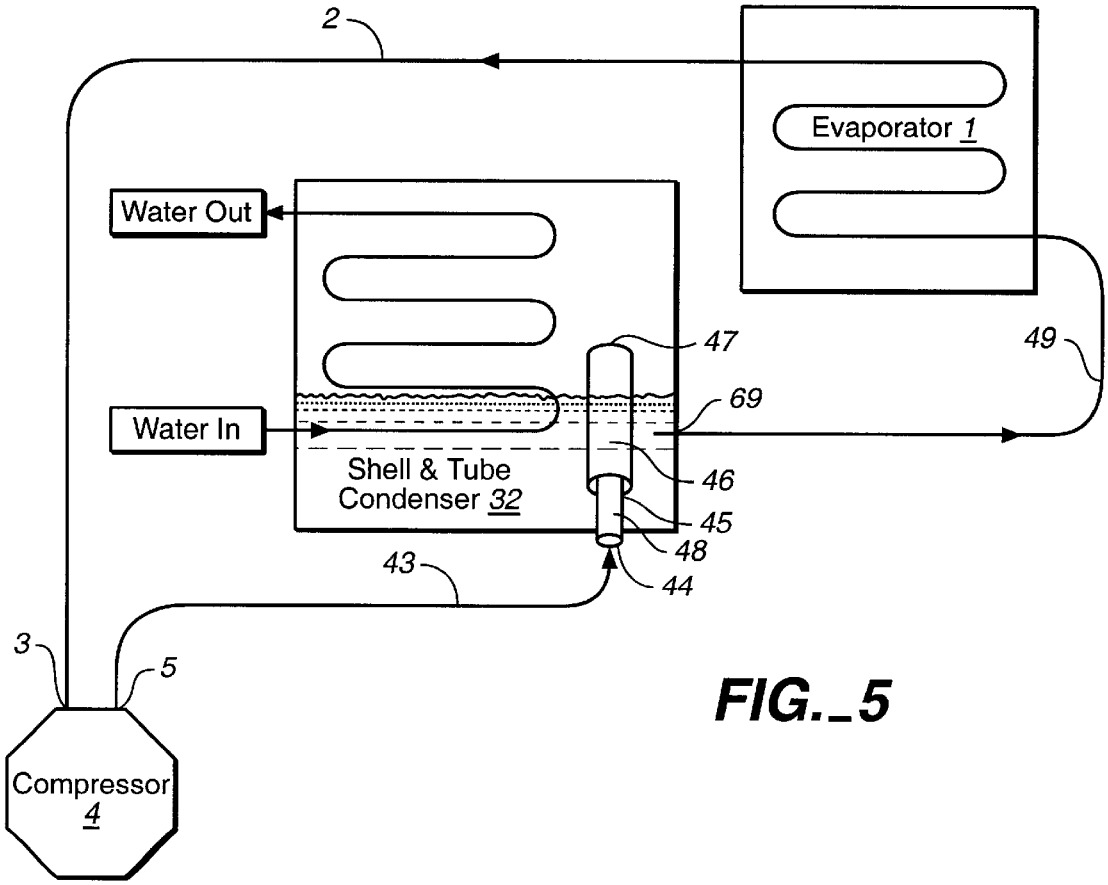
FIG. 5 is a refrigeration system with a desuperheating shell and tube condenser according to the present invention.

An embodiment of the present invention showing the desuperheating condenser is shown (FIG. 5). Gas from the evaporator 1 travels through line 2 to the entry point 3 of the compressor 4. Superheated gas leaves at point 5, and travels through line 43 to an entry point 44, comprising a short segment of pipe 48. The short segment of pipe 48 leads into the condenser 32. A second pipe 46, having a diameter greater than that of the short segment 44, fits loosely over the short segment of pipe, allowing limited mixing of the cool liquid refrigerant and superheated gas at point 45. Gas travels up the wider diameter pipe 46, and exits, as desuperheated gas, at point 47. Condensed, cool liquid refrigerant exits the condenser at point 69, and travels to line 49 to the evaporator 1.

An alternate embodiment can include an centrifugal oil separator 70, distilling oil reservoir 23, and pipe 9.

Figure 6A:
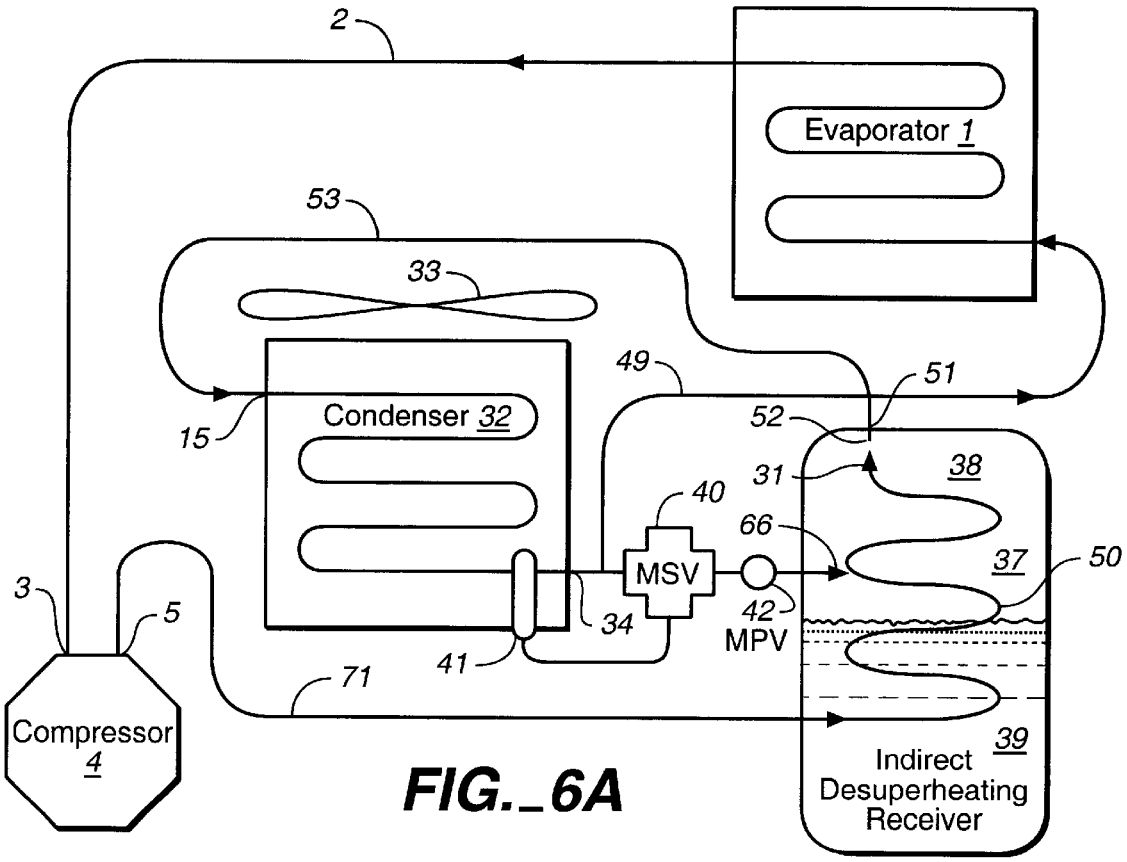
FIG. 6A is a refrigeration system having an indirect desuperheating receiver (IDR) according to the present invention.

An embodiment of the present invention an indirect desuperheating receiver, where the indirect desuperheating receiver is also a true surge receiver, is shown (FIG. 6A). The indirect desuperheating receiver shown in FIG. 6A is also a true surge receiver, because it comprises a minimum subcooling valve (MSV). The MSV is an optional component of the indirect desuperheating receiver. Gas leaving from the evaporator 1 travels through line 2 to the entry point 3 of the compressor 4. Superheated hot discharge gas leaves the compressor at point 5, and travels through line 71 to the receiver 37. The superheated gas travels through line 50, whereupon it is desuperheated by the cool liquid refrigerant in the lower portion 39 of the receiver 37. The line 50 has an open end 52 within the upper portion 38 of the receiver, where desuperheated gas exits. Desuperheated gas leaves the receiver at point 51, and travels through line 53, to the entry point 15 of the condenser. Condensed, cool liquid refrigerant exits at point 34, whereupon it can travel through line 49 to the evaporator 1, or travel through the minimum subcooling valve 40 to the entry point 66 of the receiver 37. The MPV 42 is an optional component. The probe 41 is a component of the minimum subcooling valve 40.

Figure 6B:
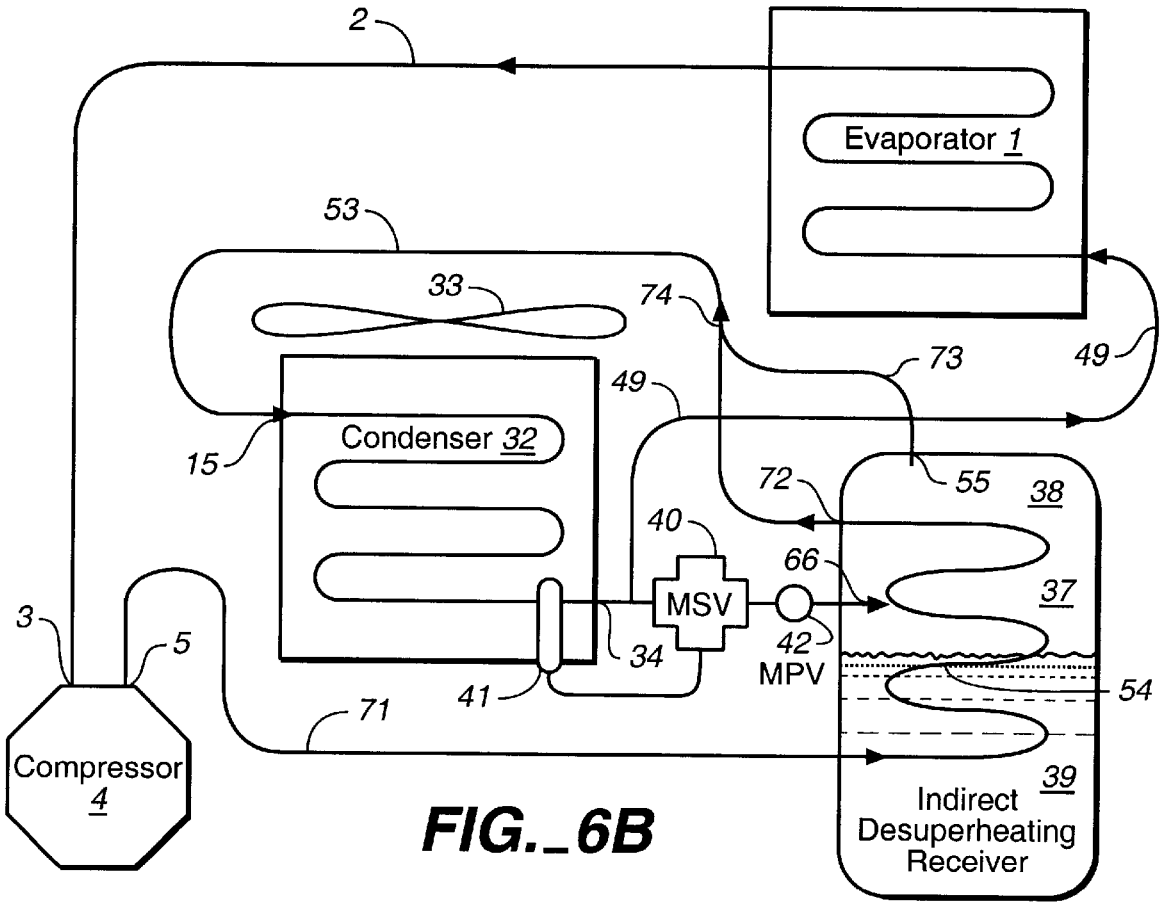
FIG. 6B is a refrigeration system having a second embodiment of an indirect desuperheating receiver (IDR) according to the present invention.

An alternate embodiment of the indirect desuperheating receiver is shown (FIG. 6B). In this alternative embodiment, superheated gas travels through line 71 to the receiver, and travels through line 54, whereupon the gas is desuperheated. The gas does not directly contact the cool liquid refrigerant in the receiver 37, during its passage through line 54 to point 72. Gas in the upper portion 38 of the receiver 37 can exit the receiver at point 55, and travel through line 73 to point 74. The desuperheated gas leaves the receiver at point 72, and travels to point 74. The desuperheated gas originating from line 54, and the gas originating from the upper portion 38 of the receiver, mix at point 74 and travel though line 53 to the entry point 15 of the condenser 32.

Figure 7:
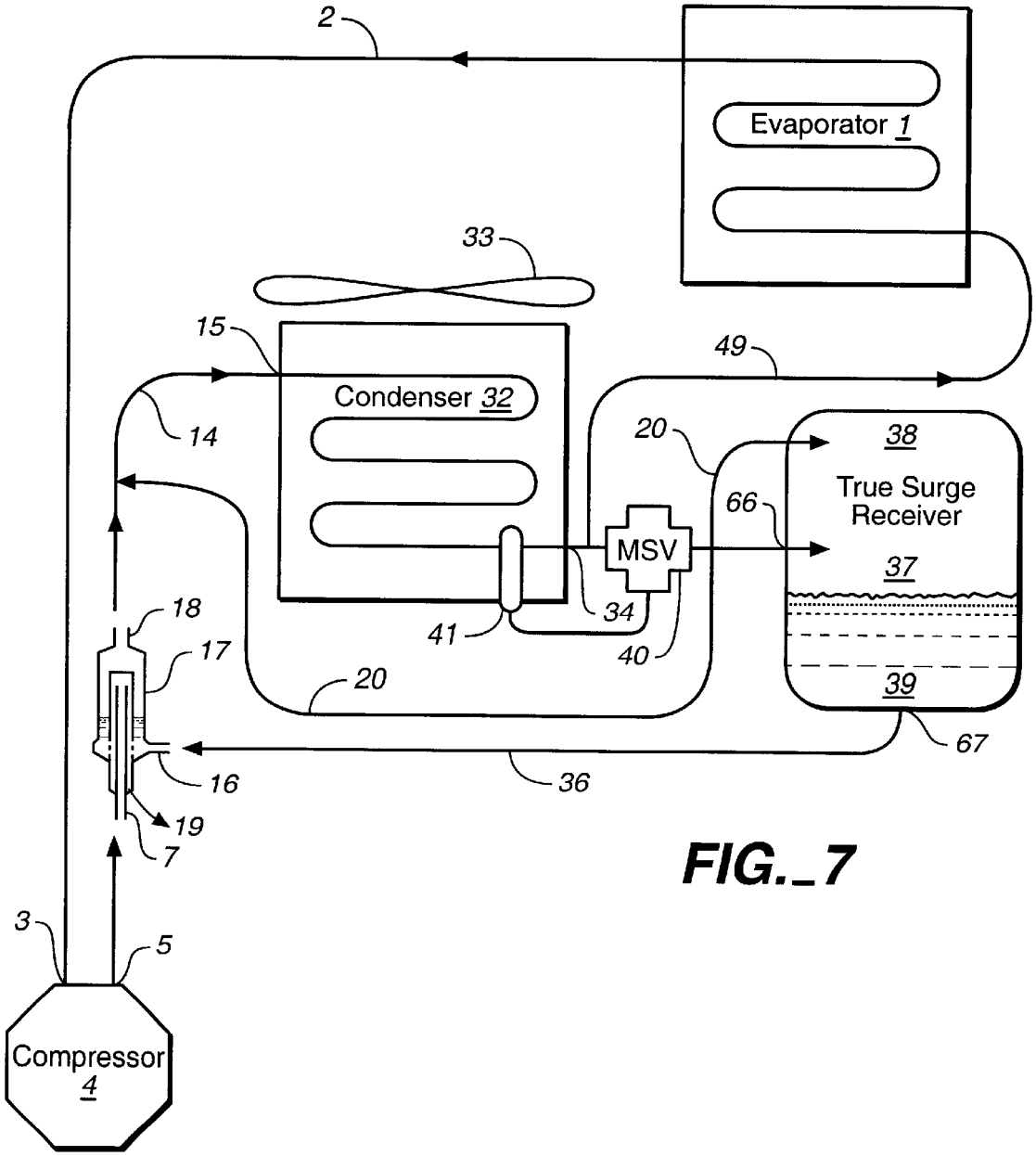
FIG. 7 is a refrigeration system according to the present invention including an alternative embodiment of a desuperheating oil scrubber (DOS).

An embodiment of the present invention included a desuperheating oil scrubber and true surge receiver is shown (FIG. 7). Gas from the evaporator 1 travels through line 2 to the entry point 3 of the compressor 4. Superheated hot discharge gas exits at point 5, and travels to the entry point 7 of the desuperheating oil scrubber 17. Cool liquid refrigerant from the condenser 32 exits from the condenser at point 34, where it can travel to the entry point 66 of the receiver, and accumulate in the lower portion 39 of the receiver 37. Cool liquid refrigerant can leave at point 67 for the desuperheating oil scrubber 17, where it enters the desuperheating oil scrubber at point 16. Desuperheated gas leaves the desuperheating oil scrubber 17 at point 18. An equalizer line 20 allows reversible passage of gas from line 14 and the upper portion 38 of the receiver 37.

Desuperheated gas travels through line 14 to the entry point 15 of the condenser 32. Condensed cool liquid refrigerant exits the condenser at point 34. The cool liquid refrigerant can either travel through line 49 to the evaporator 1, or travel through the minimum subcooling valve 40 to the entry point 66 of the receiver 37. The minimum subcooling valve 40 comprises a probe 41. An alternate embodiment includes a valve in addition to the MSV, namely, the MPV 42 (FIG. 3). An further alternate embodiment includes the gas-gas defrost valve 26, with lines 24 and 25 (FIG. 4).

Figure 8:
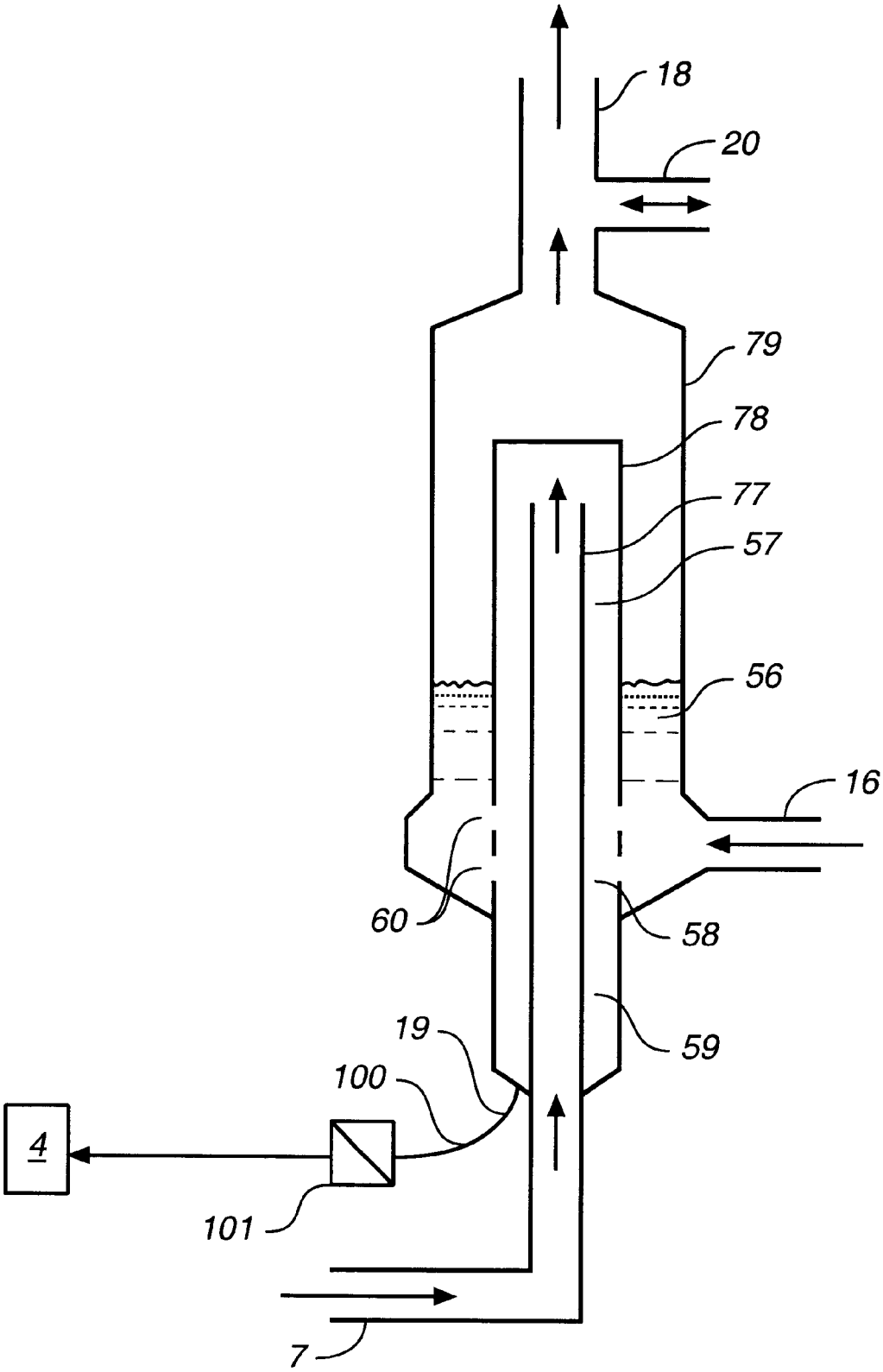
FIG. 8 is a detailed diagram of a desuperheating oil scrubber (DOS) according to the present invention as shown in FIGS. 2 and 7.

Details of the desuperheating oil scrubber (DOS) 17 are shown (FIG. 8). Superheated gas enters at point 7. The gas travels up through a smallest-diameter pipe 77, and then enters a middle diameter pipe 78. Upon traveling from region 57 to region 58, the superheated gas encounters cool liquid refrigerant. The cool liquid refrigerant, originating from point 16, can enter and exit through holes 60. The oil in the superheated gas dissolves in the liquid refrigerant, and the oil accumulates in the liquid refrigerant, resulting in a preparation of oil that is concentrated and relatively pure. The concentrated oil then drops below region 58, whereupon it exits through line 19 back to the condenser. The close contact between the superheated gas, entering at point 7, and the relatively purified oil, leaving at point 19, has the effect of heating the oil. This heating prevents condensation of refrigerant in the oil, that is, prevents contamination of the relatively purified oil with refrigerant. Desuperheated gas leaves the largest diameter pipe 79, and exits the desuperheating oil scrubber, at point 18 (FIG. 8). The relatively purified oil leaving at point 19 travels through a line 100, where the rate of flow is regulated by a valve or restriction point 101.

Figure 9B:
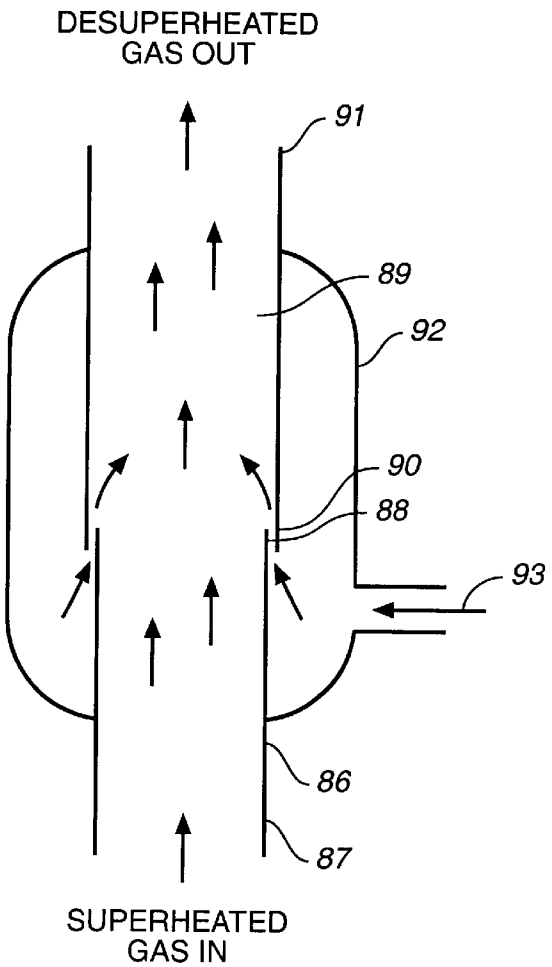
FIG. 9B is an alternate embodiment of a discharge desuperheater according to the present invention.
Figure 9A:
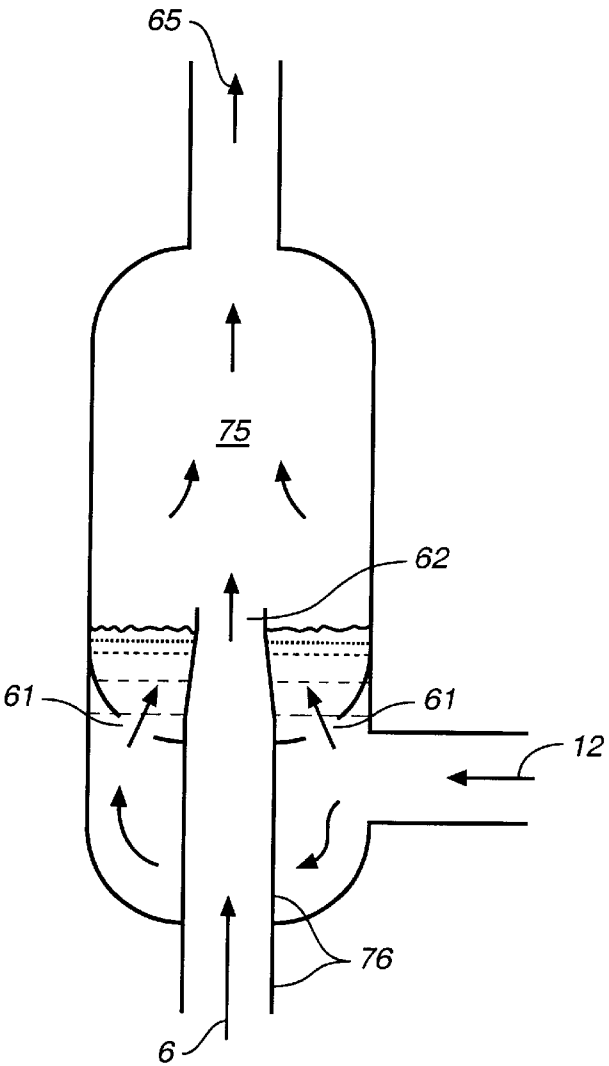
FIG. 9A is a preferred embodiment of a discharge desuperheater as shown in FIG. 1.

Details of the discharge desuperheater 11 are shown (FIG. 9A). Superheated gas enters a pipe 76 at the hot gas inlet 6, and exits at the nozzle 62. Cool liquid refrigerant enters at the inlet (or secondary line) 12, and passes through holes 61. Mixing of the gas and liquid occur in mixing chamber 75. Desuperheated gas exits the discharge desuperheater at the gas outlet 65.

In one embodiment, the pipe 76 is a straight pipe, where the diameter at the hot gas inlet 6 and nozzle 62 are equal. In another embodiment, the diameter at the nozzle 62 is slightly lesser than that at the hot gas inlet 6, where the lesser diameter at the nozzle serves to reduce turbulence, and to focus the flow of gas into outlet 65.

In a further embodiment, the pipe 76 is a straight pipe, wherein the diameters that the hot gas inlet 6 and nozzle 62 are equal, and the diameter at the hot gas outlet 65 is greater than that of the hot gas inlet 6.

Another alternate embodiment of the discharge desuperheater is shown (FIG. 9B). Superheated hot discharge gas arriving from the compressor enters pipe 86 at inlet 87. The gas exits pipe 86 at point 88, and enters pipe 89 at point 90. Pipe 86 fits loosely within pipe 90. Cool liquid refrigerant enters at inlet 93. The cool liquid refrigerant is drawn through the annular space between points 88 and 90, wherein the cool liquid refrigerant mixes with the superheated gas, producing desuperheated gas. The desuperheated gas exits from pipe 89 at outlet 91. The two pipes 86 and 89, as well as inlet 93, are connected to a cowl 92.

In fabricating or manufacturing the invention, steel or aluminum are the preferred manufacturing materials for use with ammonia-based refrigeration systems, while copper is the preferred manufacturing material for use with fluorocarbon-based refrigeration systems.

A suitable compressor is the 9RS30765 TFC from Copeland Corp. of Sidney, Ohio. This receiver suitable for use with or without modification with a desuperheater can be purchased from Standard Refrigeration Co. of Melrose Park, Ill. A suitable water-cooled evaporative condenser is the JC-80 from Recold Manufacturing. A suitable air-cooled condenser is the RC6-1196 from Larkin Manufacturing. A suitable shell and tube condenser is the KY-200 from Standard Refrigeration Co., of Melrose Park, Ill. A suitable expansion valve is the GVE-2-C from Sporlan Valve Co of St. Louis, Mo. A suitable evaporator is the HC68-135BB from Krack, Inc. of Addison, Ill. The MSV may be mechanical or electronic. A suitable electronic MSV is the CDS 16-10S electronic EPR valve (stepper motor valve) from Sporlan Valve Co. of St. Louis Mo. A suitable minimum head pressure valve is the A8 pressure regulating valve from Parker-Hannifin of Cleveland Ohio. A suitable vortex oil separator is the Tubroshed S-5608-A from Hussman Corp. of Bridgeton, Mo. An alternative source of a vortex oil separator is Henry Valve Co. of Melrose Park, Ill. A suitable defrost valve can be purchased from Amot of Richmond, Calif. One of ordinary skill in the art would be able to choose alternate sources and models of the above-mentioned parts.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. The examples and embodiments described herein are not intended to limit the number of new types of refrigeration systems that may be created by combining the desuperheaters described.

What is claimed is:

1. In a closed vapor compression refrigeration system having an expansion device and evaporator, a compressor, and a condenser, wherein liquid refrigerant is converted into gas in the expansion device and evaporator which is then fed to the compressor, wherein said gas is compressed and superheated, the superheated gas is then condensed in said condenser and converted back into cooler liquid refrigerant, a passive desuperheater for passively desuperheating said superheated gas before said gas is transmitted to said condenser comprising:

a chamber having a first inlet for receiving said superheated gas, a second inlet for receiving cooler liquid refrigerant condensed by said condenser, said second inlet positioned below the outlet of said condenser to cause said liquid refrigerant to flow to said second inlet by the force of gravity, and an outlet that outputs said desuperheated gas for transmitting to said condenser, wherein said liquid refrigerant is caused to be mixed with said superheated gas in said chamber to reduce the temperature of said gas at said outlet.

2. The desuperheater of claim 1, wherein said second inlet is positioned at a vertical level that is at least approximately six feet below said outlet of said condenser, in order to cause said liquid refrigerant to feed into the stream of superheated gas output by said compressor.

3. The desuperheater of claim 1, wherein the superheated gas is reduced to a temperature at or slightly above the refrigerant's saturation temperature by said mixed liquid refrigerant.

4. The desuperheater of claim 1, further comprising a check valve positioned between said compressor and said first inlet, said check valve preventing back flow of liquid refrigerant into said compressor.

5. The desuperheater of claim 1, further comprising a U-drop positioned between said compressor and said first inlet, said U-drop comprised of a pipe extending downwards from said compressor, and below the level of said compressor, and then extending upwards to the level of said compressor or to above the level of said compressor to connect to said first inlet of said desuperheater, said U-drop preventing back flow of liquid refrigerant into said compressor.

6. The desuperheater of claim 1, wherein said chamber further comprises a short pipe between said first inlet and said chamber, wherein desuperheating of superheated gas occurs during passage of said gas through said pipe and during passage of said gas through said chamber, wherein said short pipe comprises a first end coupled to said first inlet for receiving said superheated gas and a nozzle at its other end for discharging gas into said mixing chamber, wherein said first end of said short pipe has an inlet diameter, and wherein said nozzle of said short pipe has a nozzle diameter, wherein the short pipe is oriented so that it generates a flow of gas through said short pipe directed towards said outlet, wherein said second inlet for receiving cooler liquid refrigerant is situated below said nozzle and said outlet is situated above said nozzle, wherein said chamber further comprises an upper interior portion and a lower interior portion, wherein said short pipe resides substantially within said lower interior portion, wherein liquid refrigerant accumulates within said lower interior portion, and wherein mixing of superheated gas with cool refrigerant occurs in said upper interior portion.

7. The desuperheater of claim 6, wherein the ratio of said inlet diameter to said nozzle diameter is approximately 1.3 or less.

8. The desuperheater of claim 7, wherein the ratio of said inlet diameter to said nozzle diameter is approximately 1.0 or less.

9. The desuperheater of claim 6, wherein the ratio of said inlet diameter to said nozzle diameter is greater than 1.0.

10. The desuperheater of claim 1, further comprising:

a small diameter pipe and a middle diameter pipe, said small diameter pipe connected at one end to said first inlet and extending vertically into said chamber of predetermined distance and having a second opening at its other end, said middle diameter pipe surrounding said small diameter pipe having a first closed end and a second end, wherein superheated gas exiting from said second opening of said small diameter pipe flows against said first closed end of said middle diameter pipe and is directed towards said second end of said middle diameter pipe, wherein said middle diameter pipe forms a plurality of holes adapted to allow the passage of gas from said middle diameter pipe into said chamber near said middle diameter pipe's second end; and wherein said chamber further comprises an upper interior portion and a lower interior portion, wherein said second inlet is positioned near to said second end of said wide diameter pipe such that cooler liquid refrigerant accumulates in said lower interior position and in the region of said second end of said middle diameter pipe and such that the superheated gas flows through said accumulated cooler liquid refrigerant, to provide desuperheating of said gas, and wherein said desuperheated gas is output through said outlet.

11. The desuperheater of claim 10, wherein said middle diameter pipe further comprises an oil outlet line at its second end and wherein contact of said superheated gas with said cooler liquid refrigerant results in the separation of said oil from said superheated gas, and the accumulation of said oil near said second end of said middle diameter pipe, wherein heat from said small diameter pipe is transferred to said oil accumulated near said second end of said middle diameter pipe such that refrigerant is prevented from condensing in said oil, wherein oil is removed via said oil outlet line and returned to said compressor.

12. The desuperheater of claim 1, further comprising:

a narrow pipe positioned in said chamber having a superheated gas inlet end connected to said first inlet, a straight section, and an outlet end;

a wide pipe positioned in said chamber having an inlet end, a straight section, and a desuperheated gas outlet end connect to said outlet; and said outlet end of said narrow pipe and said inlet end of said wide pipe forming a gap such that flow of superheated gas from the narrow pipe to the wide pipe is enabled, and such that liquid from said second inlet is caused to flow through said gap into said flow of superheated gas.

13. The desuperheater of claim 1, further comprising:

a centrifugal oil separator;

an oil reservoir adapted to receiving oil from said centrifugal oil separator;

a line leading from said centrifugal oil separator to said oil reservoir; and a pipe or conduit serving to allow passage of superheated gas originating from said compressor to an inlet, with passage through said oil reservoir to an outlet, said outlet adapted to receive a line for transmitting superheated gas to said desuperheater, wherein said pipe facilitates transfer of heat from said superheated gas, through said pipe, to oil in said oil reservoir, thus beating said oil, and preventing condensation of refrigeration in said oil.

14. The desuperheater of claim 1, further comprising a gas-gas defrost valve, said gas-gas defrost valve further comprising:

an inlet adapted for receiving superheated hot discharge gas from a first line;

an inlet adapted for receiving desuperheated gas from a second line;

a valve for effecting an adjusted mixture of the superheated hot discharge gas and said desuperheated gas; and an outlet adapted for transfer of said adjusted mixture to a third line, said third line adapted for transfer of said adjusted mixture to said evaporator, wherein defrosting is effected by passage of said adjusted mixture through said evaporator.

15. The desuperheater of claim 1, further comprising a true surge receiver comprising:

a receiver adapted for holding or storing condensed cool liquid refrigerant in a lower inner portion of said receiver, and for holding gaseous refrigerant in an upper inner portion of said receiver;

a gas outlet, adapted for the transfer of gaseous refrigerant from said upper inner portion to a line leading to said condenser;

an inlet, adapted for receiving cool liquid refrigerant;

an assembly comprising a T-pipe or T-joint, further comprising three outlets or inlets, wherein said outlets or inlets are adapted for: (1) Receiving cool liquid from the condenser; (2) Transferring cool liquid refrigerant to a minimum subcooling valve (MSV), and (3) Transferring cool liquid refrigerant to an evaporator;

a minimum subcooling valve (MSV) adapted for receiving cool liquid refrigerant from a line leading from said T-pipe or T-joint, further adapted for an automatic regulatory function, wherein automatic opening or closing occurs to alter the proportion of flow of cool liquid refrigerant to said evaporator or said condenser, and still further adapted for delivering cool liquid refrigerant to a line leading to said condenser; said minimum subcooling valve further comprising a sensor, said sensor adapted for measuring the temperature or pressure, or temperature and pressure, of cool liquid refrigerant within said condenser, wherein said automatic regulatory function serves to prevent logging of the receiver and to prevent starving of the evaporator, and a line of flow for cool liquid refrigerant comprising an outlet of said condenser, said T-pipe, said MSV, and said receiver inlet.

16. The desuperheater of claim 15, wherein the minimum subcooling valve of said true surge receiver is an electronic minimum subcooling valve.

17. The desuperheater of claim 15, wherein the minimum subcooling valve of said true surge receiver is a mechanical minimum subcooling valve.

18. The desuperheater of claim 15, wherein said true surge receiver further comprises a minimum pressure valve (MPV), occurring in said line of flow downstream of said minimum subcooling valve (MSV) and upstream of said receiver inlet, wherein said minimum pressure valve (MPV) serves a regulatory function when the MSV is held in a full open position.

19. In a closed vapor compression refrigeration system having an expansion device and evaporator, a compressor, and a condenser, wherein liquid refrigerant is converted into gas in the expansion device and evaporator which is then fed to the compressor, wherein said gas is compressed and superheated, the superheated gas is then condensed in said condenser and converted back into cooler liquid refrigerant, a passive desuperheater for passively desuperheating said superheated gas before said gas is transmitted to said condenser comprising:

a receiver having a top and a bottom, said bottom defining a lower interior portion and said top defining an upper interior portion, said lower interior portion adapted for holding cool liquid refrigerant and said upper interior portion adapted for holding gaseous refrigerant, a gas inlet for receiving said superheated gas from a line connected to said compressor, and further for transferring said superheated gas to said lower interior portion of said receiver, said received superheated gas being cooled during transit through said lower interior portion of said receiver, and a gas outlet for outputting said cooled gas for transmission to said condenser.

20. The desuperheater of claim 19, wherein said gas inlet enables superheated gas to contact cool liquid refrigerant within said lower interior portion, causing desuperheating of said gas, which then exits the receiver at said gas outlet.

21. The desuperheater of claim 19, wherein said receiver further comprises an interior pipe having a first end connected to said gas inlet and a second end open to said upper interior portion, such that said passage of superheated gas through said interior pipe causes transfer of heat from said superheated gas through the wall of said pipe to the cool liquid refrigerant within said lower interior portion, to create desuperheating of said gas.

22. The desuperheater of claim 19, wherein said receiver further comprises an interior pipe, having a first end connected to said gas inlet and a second end, and a second gas outlet, said second end of said interior pipe connected to said second gas outlet, such that passage of superheated gas through said interior pipe causes transfer of heat from said superheated gas through the wall of said pipe to the cool liquid refrigerant in said lower interior portion, to create desuperheating of said gas, and where second gas outlet is connected to a line leading to said condenser.

23. The desuperheater of claim 19, further comprising a true surge receiver comprising:

a receiver adapted for holding or storing condensed cool liquid refrigerant in a lower inner portion of said receiver, and for holding gaseous refrigerant in an upper inner portion of said receiver;

a gas outlet, adapted for the transfer of gaseous refrigerant from said upper inner portion to a line leading to said condenser;

an inlet, adapted for receiving cool liquid refrigerant;

an assembly comprising a T-pipe or T-joint, further comprising three outlets or inlets, wherein said outlets or inlets are adapted for: (1) Receiving cool liquid from the condenser; (2) Transferring cool liquid refrigerant to a minimum subcooling valve (MSV), and (3) Transferring cool liquid refrigerant to an evaporator;

a minimum subcooling valve (MSV) adapted for receiving cool liquid refrigerant from a line leading from said T-pipe or T-joint, further adapted for an automatic regulatory function, wherein automatic opening or closing occurs to alter the proportion of flow of cool liquid refrigerant to said evaporator or said condenser, and still further adapted for delivering cool liquid refrigerant to a line leading to said condenser; said minimum subcooling valve further comprising a sensor, said sensor adapted for measuring the temperature or pressure, or temperature and pressure, of cool liquid refrigerant within said condenser, wherein said automatic regulatory function serves to prevent logging of the receiver and to prevent starving of the evaporator, and a line of flow for cool liquid refrigerant comprising an outlet of said condenser, said T-pipe, said MSV, and said receiver inlet.

24. In a vapor compression refrigeration system comprised of an expansion device, evaporator, compressor, and condenser, a passive desuperheater for passively desuperheating the superheated gas generated by said compressor, said passive desuperheater comprising:

a shell and tube condenser, comprising an inlet and an outlet, said inlet and outlet adapted for the passage of a coolant such as water, an upper interior portion and a lower interior portion, said lower interior portion containing condensed refrigerant, and said upper interior portion containing gaseous refrigerant, an outlet adapted for removal of cool liquid refrigerant from said lower interior portion, a superheated gas inlet adapted to receive a line, said line providing superheated hot discharge gas from said compressor, a narrower pipe connected to said superheated gas inlet, and a wider pipe, comprising a first end opening and second end opening, wherein said first end opening is loosely fitted over said narrower pipe, where there is a region of overlap of said narrower pipe and said wider pipe, where in said region of overlap, said narrower pipe is nested within said wider pipe, and where cool liquid refrigerant enters said wider pipe at said region of overlap and mixes with the flow of superheated gas, and where said mixture flows through said wider pipe and is discharged from said second end opening of said wider pipe into said upper interior portion of said receiver as desuperheated gas.

* * * * *